United States Patent [19]

Epstein

[11] 4,400,932

[45] Aug. 30, 1983

[54] MODULAR JEWELRY LINK

[75] Inventor: Elias Epstein, Flushing, N.Y.

[73] Assignee: Kaspar & Esh, Inc., New York, N.Y.

[21] Appl. No.: 378,323

[22] Filed: May 14, 1982

[51] Int. Cl.[3] ..... F16G 13/18

[52] U.S. Cl. ..... 59/82; 63/28

[58] Field of Search ..... 59/80, 82, 78, 90, 84; 63/28, 4, 2, 26, 27

[56] References Cited

U.S. PATENT DOCUMENTS

| | | | |
|---|---|---|---|
| 1,153,362 | 9/1915 | Wacha | 63/4 |
| 1,344,365 | 6/1920 | Wachenheimer | 63/4 |
| 1,376,866 | 5/1921 | Felger | 59/80 |
| 1,467,468 | 9/1923 | Blanchard | 59/80 |
| 1,701,610 | 2/1929 | Forstner | 63/4 |
| 1,734,625 | 11/1929 | Hayman | 59/80 |
| 2,136,818 | 11/1938 | Kestenman | 59/80 |
| 4,015,423 | 4/1977 | Brunet | 59/82 |

*Primary Examiner*—Gene Crosby

*Attorney, Agent, or Firm*—Burgess, Ryan & Wayne

[57] ABSTRACT

A jewelry link in the form of an elongated loop capable of holding and displaying a number of precious stones or the like. The link has a closed U-shaped ring at one end and a corresponding hole at the other end, so that the ring of one link may be inserted into the hole of an adjacent link. Each link has a deformable hook secured adjacent the ring-receiving hole, so that when the U-shaped ring of an adjacent link is inserted in the hole, the two links can be locked together by pressing the deformable hook so that it interlocks with the inserted ring. By this means links can be added to a bracelet or necklace as the wearer is able to purchase them; and in similar fashion additional precious stones can be added to each link as desired.

7 Claims, 10 Drawing Figures

FIG. 1
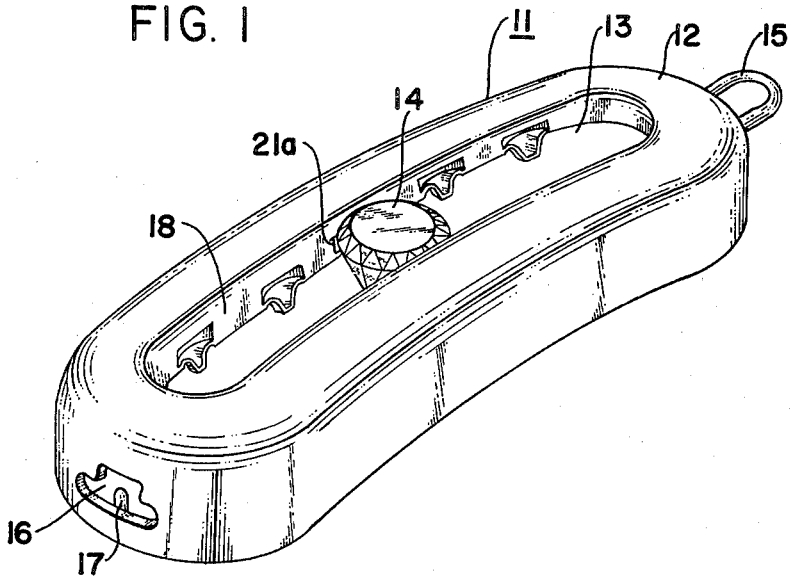
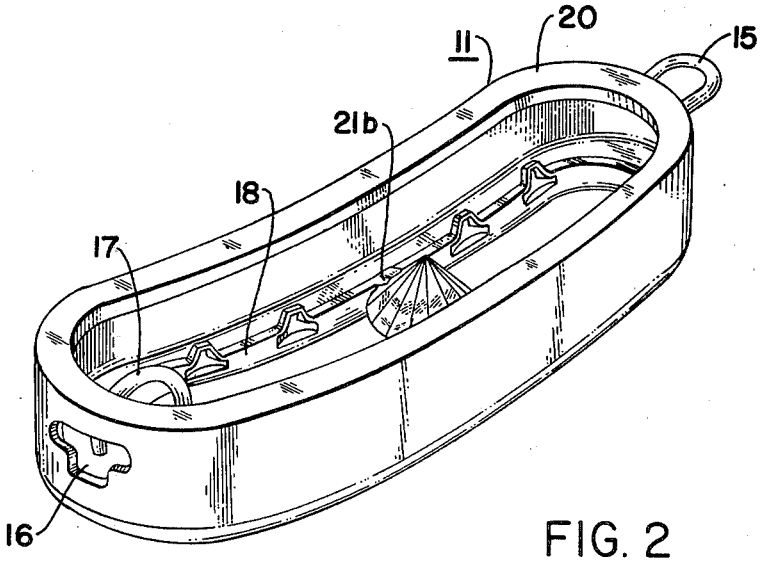
FIG. 2

FIG. 8
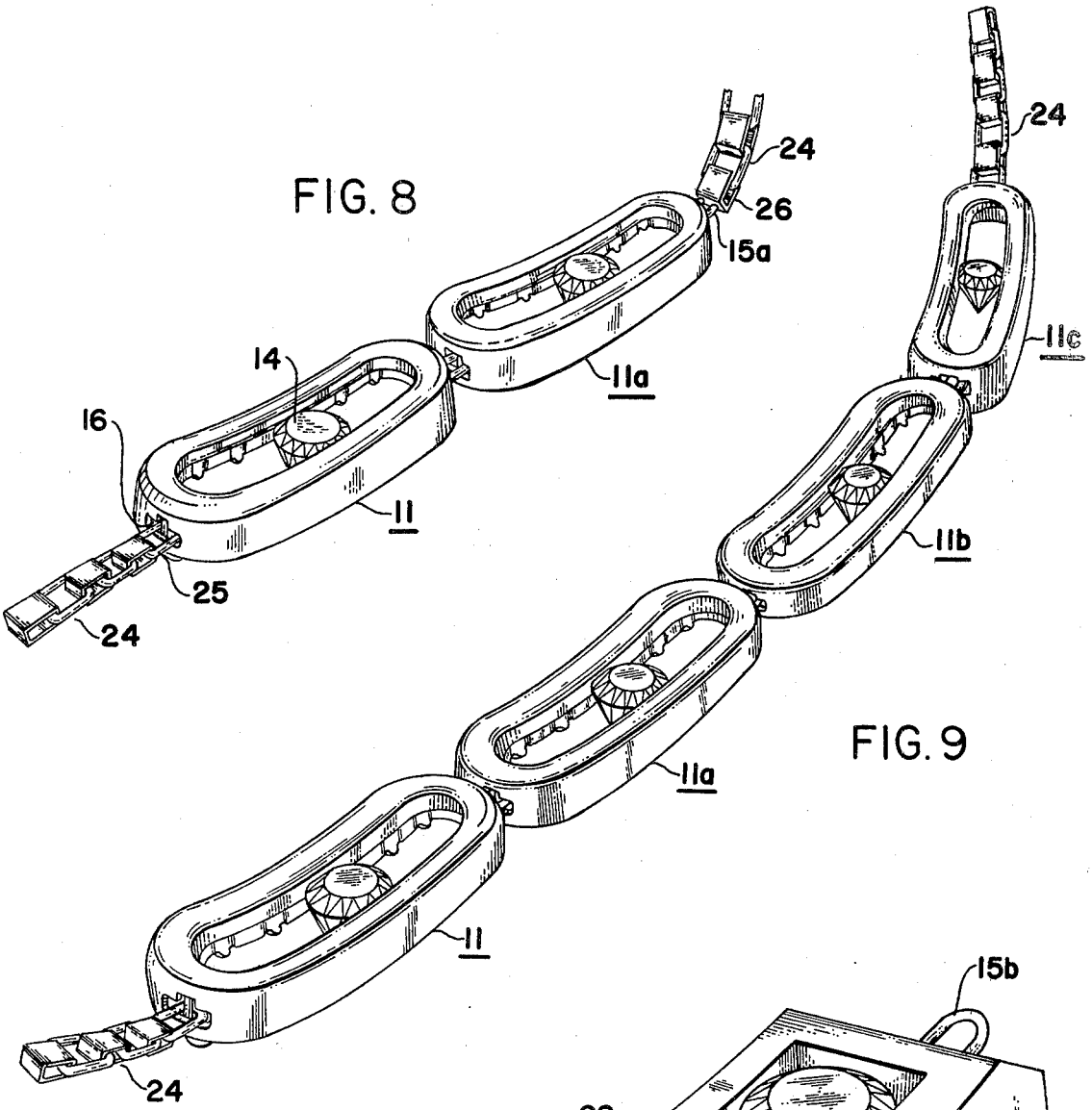
FIG. 9
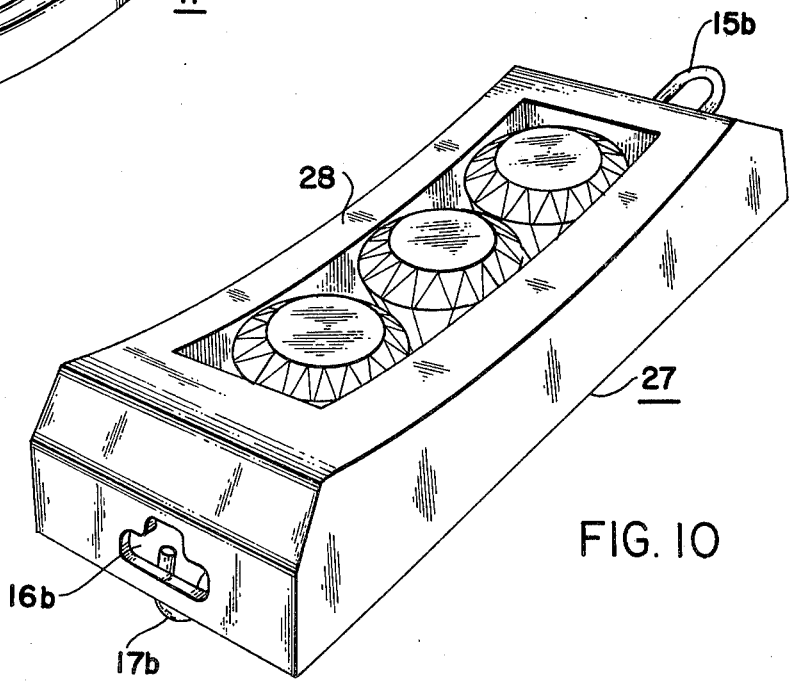
FIG. 10

MODULAR JEWELRY LINK

BACKGROUND OF THE INVENTION

This invention relates to a jewelry link for holding one or more precious stones or the like, and more particularly to a link which is capable of being connected to similar links in modular fashion.

Most people are initially able to afford only a limited amount of jewelry; and are able to afford additional or more expensive jewelry as time goes on. In many cases the initially acquired jewelry is given away, sold, or simply not used, when more expensive jewelry is later acquired.

There is need for a modular system permitting high quality jewelry to be acquired in stages, i.e., so that the wearer can purchase additional parts of an item of jewelry previously acquired, to enhance the appearance of the same. It is desirable, of course, that the expansion of the item of jewelry be relatively simple and inexpensive to accomplish.

Accordingly, an object of the present invention is to provide an item of jewelry having the aforementioned features.

SUMMARY

As herein described, there is provided a jewelry link for holding one or more precious stones or the like comprising an elongated loop having a closed U-shaped ring protruding from one end thereof and a ring-receiving hole in the opposite end thereof, said loop having an elongated internal hole extending between said ends, a deformable hook secured to said loop adjacent said ring-receiving hole and adapted to be deformed to engage the U-shaped ring of another similar loop when said other U-shaped ring is extended through said ring-receiving hole.

IN THE DRAWING

FIG. 1 is a perspective view showing the outer (decorative) surface of a link according to a preferred embodiment of the present invention, with a single diamond or similar precious stone installed therein;

FIG. 2 is a perspective view of the link shown in FIG. 1, showing the bottom (unornamented) surfaces of said link;

FIG. 8 is a perspective view showing the ornamental surfaces of two links of the type shown in FIG. 1, mutually interconnected with each other and in ornamental chain; FIG. 9 is similar to FIG. 8, but shows four mutually interconnected links; and FIG. 10 is a perspective view of another type of link according to the invention, containing three diamonds or other precious stones.

DETAILED DESCRIPTION OF THE INVENTION

Figure 3:
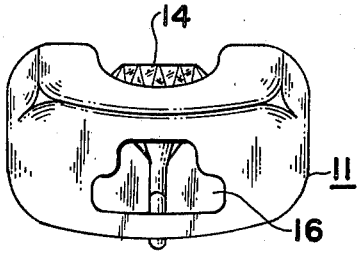
FIG. 3 is a left side elevation view of said link.
Figure 4:
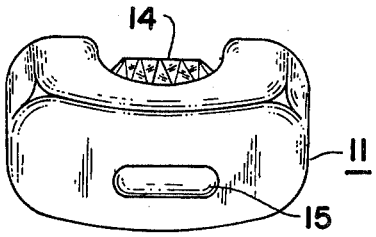
FIG. 4 is a right side elevation view of said link.

As seen in FIGS. 1 and 2, a jewelry link 11 has an elongated generally oval shape with a slight lateral curvature or "kidney" configuration. The link 11 is preferably made of gold or silver, or alternatively may be gold or silver plated.

The ornamental upper surface 12 of the link 11 surrounds an elongated internal hole 13 within which up to five diamonds or other precious stones may be mounted, the link 11 being shown in FIG. 1 with a single diamond 14 mounted therein.

An elongated loop 15 in the form of a closed U-shaped ring protrudes from one end of the link 11, while a ring-receiving hole 16 is disposed in the opposite end of the link 11, the loop 15 and hole 16 lying in essentially the same plane.

Figure 5:
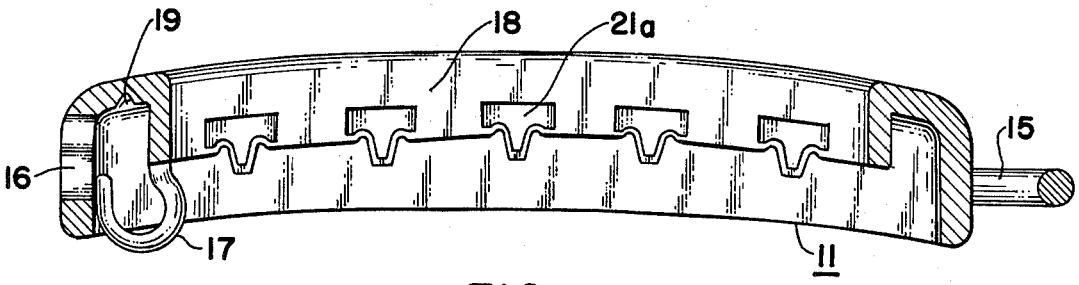
FIG. 5 is a longitudinal cross-sectional view of said link.

As best shown in FIG. 5, a deformable hook 17 is secured to the inner peripheral lip 18 which extends from the ornamental surface 12 of the link 11 to surround the internal hole 13, so that the free end of the hook 17 is disposed adjacent the bottom of the ring-receiving hole 16. A generally conical recess 19 is formed in the inside surface of the upper part of the link 11, to accommodate the free end of the hook 17 when said hook is deformed to engage the loop of an adjacent link, as best shown by the engagement of the hook **17*a* with the recess 19*a*, in FIG. 6**.

As best shown in FIG. 2, the bottom of the link 11 has an inwardly extending flange 20 which serves to increase the mechanical strength of the link 11 and to provide a smooth surface of contact between the link 11 and the clothing or skin of the wearer.

Figure 7:
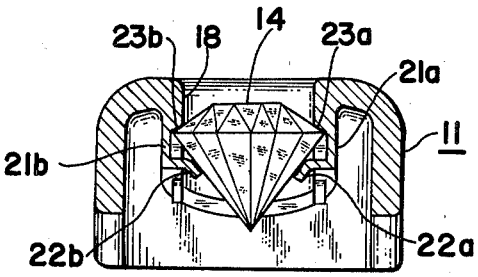
FIG. 7 is a right or left side cross-sectional elevation view showing the manner in which the diamond or other precious stone is mounted in the link of FIG. 1.

A series of five pairs of flanges **21*a* and 21*b* are disposed in mutual juxtaposition, in opposite sides of the longitudinal walls of the lip 18. As shown in FIG. 7, the bottom portions 22*a* and 22*b* of these flanges may be deformed to abut the precious stone to be retained thereby, i.e., by wedging the precious stone between the deformed ends of said flanges and shoulder portions 23*a* and 23*b* at the upper edge of the lip 18**.

Preferably, the entire structure of the link 11 is made of gold, although other metals having suitable ornamental and mechanical characteristics can be employed.

The precious stone 14 is inserted from the bottom of the link 11 into the internal hole 13, until the upper periphery of the stone abuts the shoulders **23*a* and 23*b*; the flange ends 22*a* and 22*b*** then being deformed to retain the stone in position.

To secure a link 11 to an adjacent indentical link **11*a* (see FIG. 6), the loop 15 of the link 11 is inserted through the ring-receiving hole 16*a* of the link 11*a*, after which the hook 17*a* of the link 11*a* is deformed by pressing the free end thereof into the conical recess 19*a*, so that the hook 17*a* cooperates with the body of the link 11*a* to form a closed loop which interlocks with the loop 15 to retain the links 11 and 11*a*** in mutual engagement, while permitting sufficient rotation of the links relative to each other to allow them to conform to the clothing or skin of the wearer.

Figure 6:
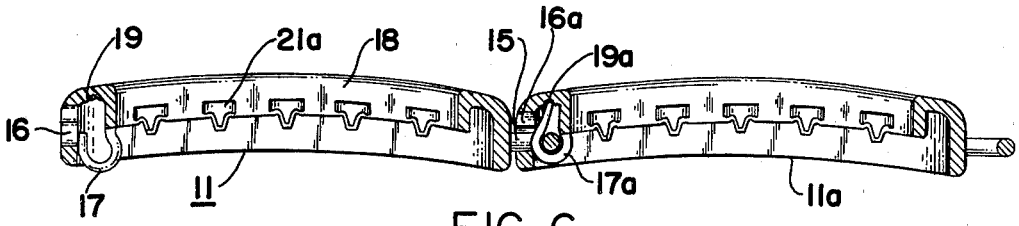
FIG. 6 is a longitudinal cross-sectional view of two of said links which have been mutually interconnected according to the present invention.

Thereafter, the engaged links 11 and **11*a* are secured to a gold or other precious or decorative metal chain 24 as shown in FIG. 8. One end of the chain 24 comprises a link 25 which engages the link 11 via the ring-receiving hole 16, in the same manner that the loop 15 engages the link 11*a* as shown in FIG. 6**.

The other end of the chain 24 comprises a flat link 26 which is initially open, and which is disposed around the end of the loop 15*a* of the link 11*a*, the flat link 26 then being crimped to interlock with the loop 15*a*.

Each of the links 11 and 11*a* may be enhanced by adding additional diamonds or other precious stones thereto. While the particular links illustrated in FIG. 8 can each accommodate up to five precious stones, obviously smaller or larger links can be constructed to accommodate fewer or greater numbers of precious stones.

Further, additional similar links can be added at the ends of the links 11 and 11*a* which are shown connected to the chain 24 in FIG. 8, in the same manner that the links 11 and 11*a* are connected to each other. For this purpose, the flat link 26 is opened, the desired number of additional links is connected to the link 11*a*, and the flat link 26 is closed to interlock with the exposed loop of the last link added. When this is done, it may be desirable to shorten the chain 24, which can be done by removing individual links of the chain 24 (or substituting another chain therefor), as is well known in the art.

FIG. 9 shows the resulting necklace configuration after two additional links 11*b* and 11*c* have been added to the interconnected links 11 and 11*a* of FIG. 8.

FIG. 10 shows a link 27 which has a rectangular rather than a generally oval-shaped configuration, with a slightly concave upper decorative surface 28. The loop 15*b*, ring-receiving hole 16*b* and hook 17*b* are identical to the corresponding parts of the links 11 and 11*a*.

What is claimed is:

1. A jewelry link for holding one or more precious stones or the like, comprising:

an elongated loop having a closed U-shaped ring protruding from one end thereof and a ring-receiving hole in the opposite end thereof;

said loop having an elongated internal hole extending between said ends, and a deformable hook secured to said loop adjacent said ring-receiving hole and adapted to be deformed to engage the U-shaped ring of another similar loop when said other U-shaped ring is extended through said ring-receiving hole.

2. The link according to claim 1, wherein said U-shaped ring and said ring-receiving hole of said loop lie in substantially the same plane.

3. The link according to claim 1 or 2, wherein said deformable hook of said loop lies in a plane substantially perpendicular to the plane of said U-shaped ring thereof.

4. The link according to claim 1 or 2, wherein said opposite end of said loop has a generally conical recess for receiving the free end of said deformable hook when said hook is deformed to engage said U-shaped ring of said similar loop.

5. The link according to claim 1 or 2, further comprising a plurality of pairs of deformable flanges extending from opposite longitudinal edges of said internal hole, for securing a corresponding plurality of precious stones or the like within said internal hole.

6. A jewelry link for holding one or more precious stones or the like, comprising:

an elongated loop having a closed U-shaped ring protruding from one end thereof in a given plane, and a ring-receiving hole in said plane at the opposite end thereof, said loop having an elongated internal hole extending between said ends, a deformable hook secured to said loop adjacent said ring-receiving hole and adapted to be deformed to engage the U-shaped ring of another similar loop when said latter U-shaped ring is extended through said ring-receiving hole, said hook of said loop lying in a plane substantially perpendicular to the plane of said U-shaped ring thereof, and said opposite end of said loop having a generally conical recess for receiving the free end of said deformable hook when said hook is deformed to engage said U-shaped ring of said similar loop.

7. The link according to claim 6, further comprising a plurality of pairs of deformable flanges extending from opposite longitudinal edges of said internal hole, each pair being adapted to secure a corresponding precious stone or the like within said internal hole.

* * * * *